United States Patent [19]

Horino et al.

[11] 4,334,619

[45] Jun. 15, 1982

[54] APPARATUS FOR PROCESSING PAPER SHEETS

[75] Inventors: Shigeo Horino; Yoshiro Hashimoto, both of Tokyo, Japan

[73] Assignee: Tokyo Shibaura Denki Kabushiki Kaisha, Kawasaki, Japan

[21] Appl. No.: 98,328

[22] Filed: Nov. 27, 1979

[30] Foreign Application Priority Data

Nov. 30, 1978 [JP] Japan ..... 53-147266

[51] Int. Cl.[3] ..... B07C 5/344

[52] U.S. Cl. ..... 209/551; 209/534; 209/548

[58] Field of Search ..... 209/534, 548, 549, 551; 194/4 R, 4 B, 4 C, 4 D, 4 E, 4 F, 4 G; 414/41, 45; 198/408

[56] References Cited

U.S. PATENT DOCUMENTS

| | | | |
|---|---|---|---|
| 3,710,936 | 1/1973 | Mizunuma | 209/551 X |
| 3,759,382 | 9/1973 | Walkley et al. | 209/534 |
| 3,930,581 | 1/1976 | Gray | 209/551 X |
| 3,932,272 | 1/1976 | Carnes, Jr. et al. | 209/534 |
| 3,938,663 | 2/1976 | Carnes et al. | 209/534 |
| 3,976,198 | 8/1976 | Carnes, Jr. et al. | 209/534 |
| 4,020,616 | 5/1977 | Nakajima et al. . | |
| 4,025,420 | 5/1977 | Horino | 209/534 |

*Primary Examiner*—David A. Scherbel
*Assistant Examiner*—Edward M. Wacyra
*Attorney, Agent, or Firm*—Cushman, Darby & Cushman

[57] ABSTRACT

An apparatus for processing paper sheets, in which one lot of paper sheets are set in a supplying section and supplied one after another to a detecting section for sorting these paper sheets into fit paper sheets and unfit paper sheets. The unfit paper sheets collected are manually counted by the operator, and their number is inputted as key-in-data. The inputted number of unfit paper sheets is added to the automatically counted number of fit paper sheets, and the resultant sum is checked up with a preset paper sheet number of one lot. The processed fit paper sheets are received in a temporary collecting section until completion of the checkup of the paper sheet number of one lot.

8 Claims, 13 Drawing Figures

FIG. 2A
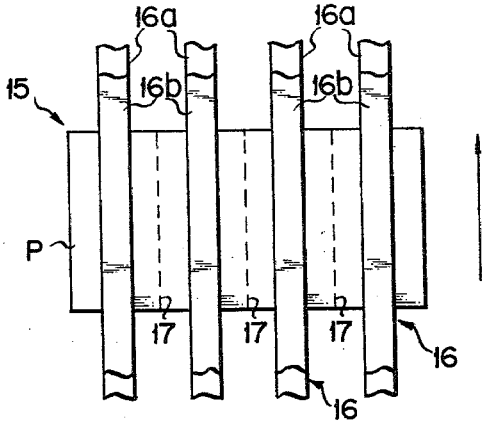
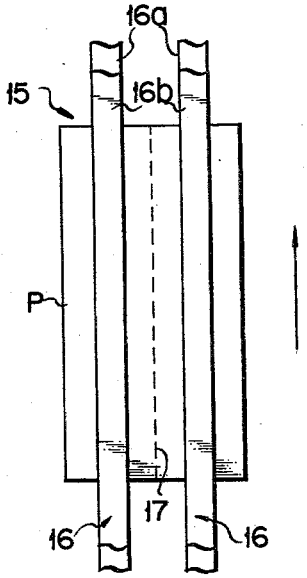
FIG. 2B
FIG. 8
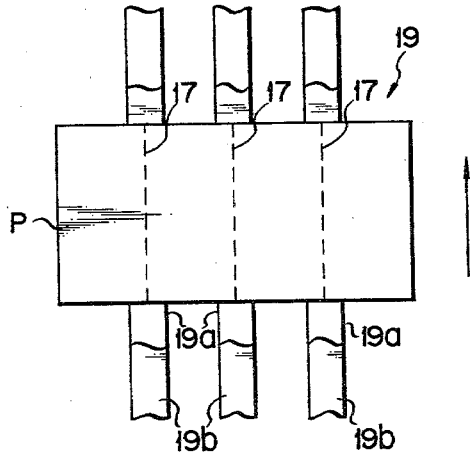

APPARATUS FOR PROCESSING PAPER SHEETS

This invention relates to an apparatus for processing paper sheets such as bank notes and securities through sorting.

This kind of apparatus has recently been developed as shown in, for instance, U.S. Pat. No. 4,025,420 and puts to practical use. In this type of apparatus, paper sheets supplied one after another from a supplying section are sorted into those fit to be processed by the apparatus and those which are unfit, and fit paper sheets are further sorted into normal paper sheets suitable for circulation and stained and/or damaged paper sheets called damaged sheets unsuitable for circulation. The sorted paper sheets are collected in individual collecting sections, while the fit paper sheets, that is, normal and damaged paper sheets capable of being processed are individually counted and collected together in the form of bundles, each having a preset number of sheets.

In the paper sheet discriminating operation of this apparatus, unfit paper sheets, for instance those extremely stained or damaged so that they cannot be identified as such, those of denominations other than that for being processed, that is, irrelevant paper sheets, and forged bank notes, are rejected as being unfit for being processed.

In this case, it has been in practice to temporarily stop the operation of discriminating paper sheets, manually collect and count the rejected unfit paper sheets, add the counted number of the unfit paper sheets and the number of fit paper sheets counted by the apparatus, compare the sum with the preset number of initially loaded paper sheets and, if the compared numbers do not coincide with each other, check the fit paper sheet bundles discharged from the apparatus as processed paper sheets. The discharged fit paper sheets are usually successively collected in a bucket placed on a conveyor and transported when fully filled in the bucket, and therefore upon occurrence of non-coincidence it is very difficult to check the paper sheet bundles of the relevant lot. This is because for checking the relevant paper sheet bundles a greater number of paper sheet bundles including those which are or have been transported have to be examined, and this requires extreme man-hour and is very inefficient.

This drawback is attributable to the facts that it is impossible to discriminate processed paper sheets of one lot since the processed fit paper sheets of one lot are successively discharged as bundles to the outside of the apparatus before completion of the processing of discrimination of all paper sheets of that lot and that the prior-art apparatus of this kind incorporates no means of recording data about excluded unfit paper sheets.

An object of the invention is to provide an apparatus for processing paper sheets, which can solve the aforementioned problems in the prior-art apparatus of this kind and permits ready checking of the numbers of processed fit paper sheets and rejected unfit paper sheets with respect to the preset number of the initially loaded paper sheets so that improved quality of paper sheet number control can be obtained, and also with which troubles of counting due to a paper sheet transfer fault can be prevented to obtain efficient paper sheet number control of high precision of discrimination.

The construction of the apparatus for processing paper sheets according to the invention, achieving the above object, is briefly as follows.

With the apparatus according to the invention, processed fit paper sheets, among the initially loaded lot of paper sheets, are not discharged to the outside of the apparatus but collected in the form of paper sheet bundles in a temporary collecting section inside the apparatus before completion of checkup with the paper sheet number of the lot. The rejected unfit paper sheets are manually counted by the operator, and the counted number is inputted as key-in-data for visually recording it. The number of fit paper sheets, and sometimes the number of other bank notes, that is, paper sheets issued from different banks, are added to the recorded unfit paper sheet number, the resultant sum is checked up with the number of the initially loaded paper sheets of one lot, and the result is recorded together with the process of the checkup. When coincidence is obtained in the checkup, the paper sheet bundles collected in the temporary collecting section is discharged at once to the outside of the apparatus.

Thus, according to the invention in case of non-coincidence of checkup it is necessary to check paper sheets for only one lot, and this is very efficient. In addition, since the number of processed paper sheets inclusive of the number of unfit paper sheets and the result of checkup are preservably recorded by a recorder, confirmation of paper sheet number and follow-up can be readily made by the operator.

Further, the apparatus according to the invention includes overlap detectors for detecting overlapping paper sheets, which detectors are provided separatedly of the main detecting section for discriminating paper sheets and disposed near collecting sections for respective sorted paper sheets, so that more accurate transfer fault checking can be obtained.

In a preferred embodiment of the invention, the transfer system for transferring paper sheets from the supplying section to the detecting section is constituted by a plurality of parallel belt pairs. These belt pairs are spaced apart and disposed relative to a paper sheet transferred by them such that they clamp portions of the paper sheet other than those containing presumable creases. The presumable creases of the paper sheet and the neighboring portions thereof are most likely to be stained and/or damaged, and since the crease-containing portions are fully detected in the detecting section, adverse effects of the transfer belts upon the discrimination of paper sheets can be minimized.

In a further preferred embodiment of the invention, normal paper sheets and damaged paper sheets, these sheets being discriminated as fit paper sheets, are supplied through respective take-out mechanisms and transfer mechanism to a bundling unit, and they are transferred substantially over the same distance to the bundling unit. Further, a common lift means is provided for both the transfer mechanisms.

Thus, it is possible to simplify the paths of transferring the normal and damaged paper sheets up to the bundling unit and the control of transfer and also minimize the generation of transfer errors.

This invention can be more fully understood from the following detailed description when taken in conjunction with the accompanying drawings, in which:

FIGS. 1A and 1B constitute a schematic of the entirety of an apparatus for processing paper sheets embodying the invention;

FIGS. 2A and 2B are views showing respective fashions of transfer of a paper sheet by paper sheet transfer belts in the processing apparatus shown in FIGS. 1A and 1B;

Figure 5A:
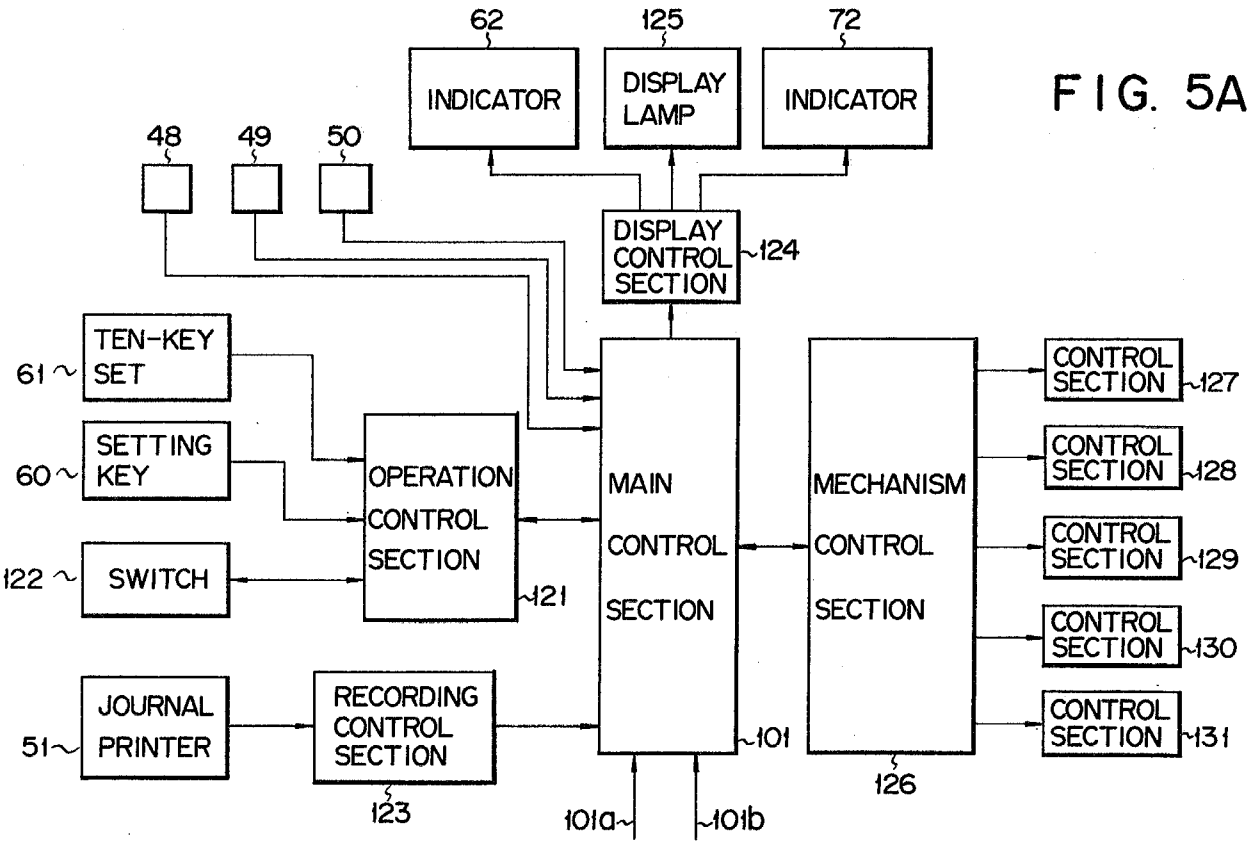
Figure 5B:
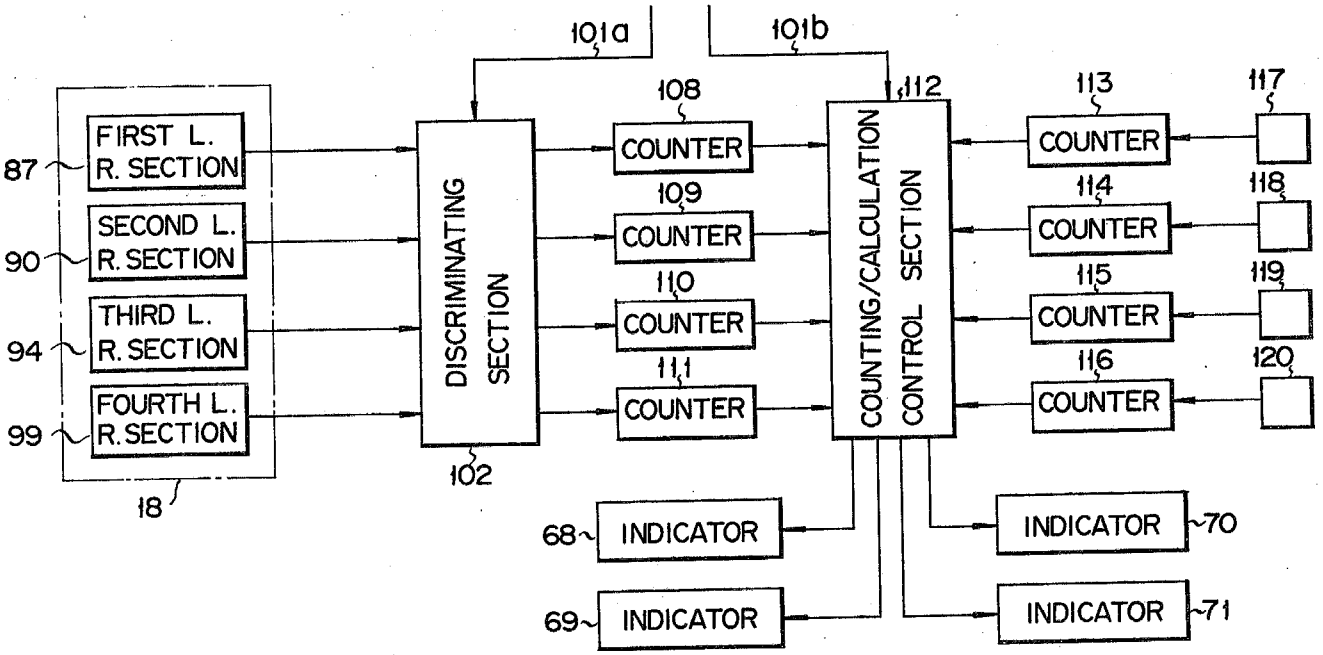
Figure 6:
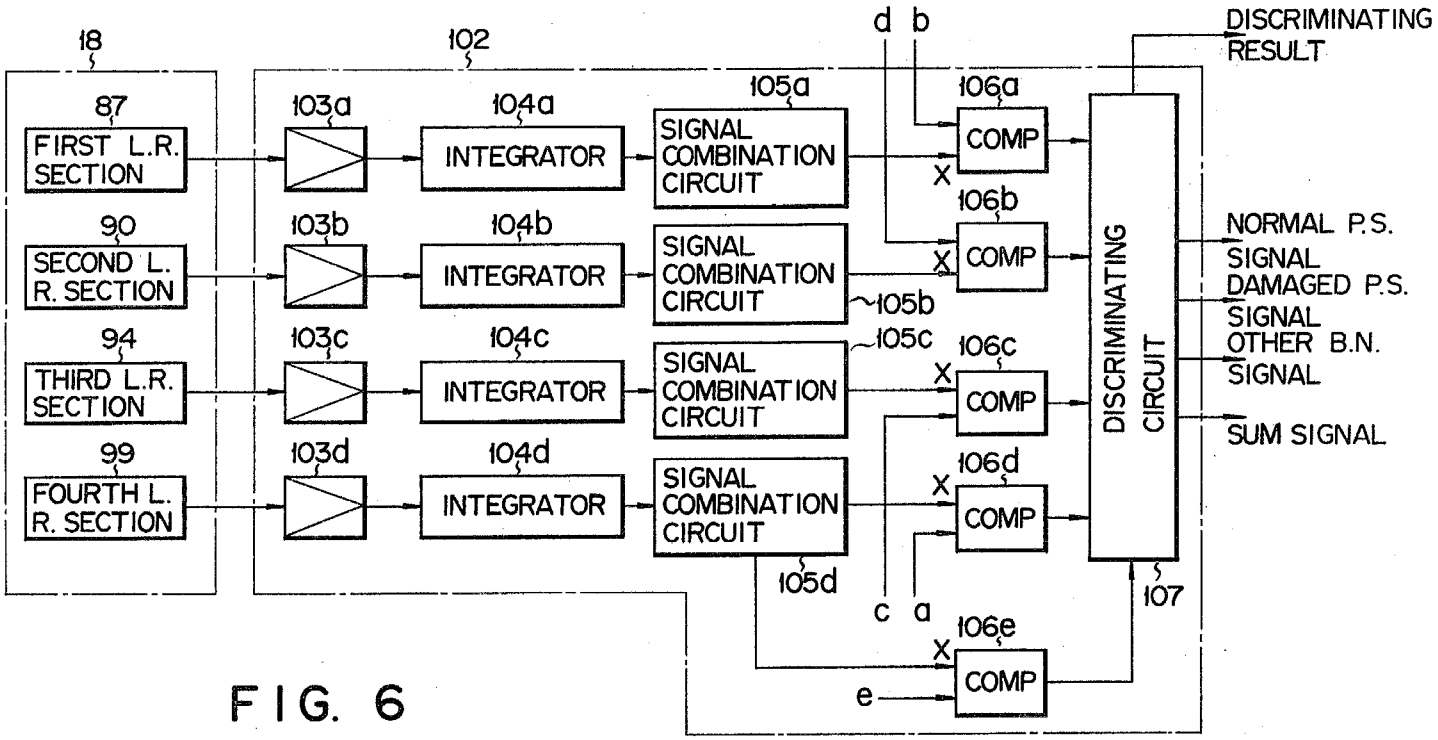
Figure 7:
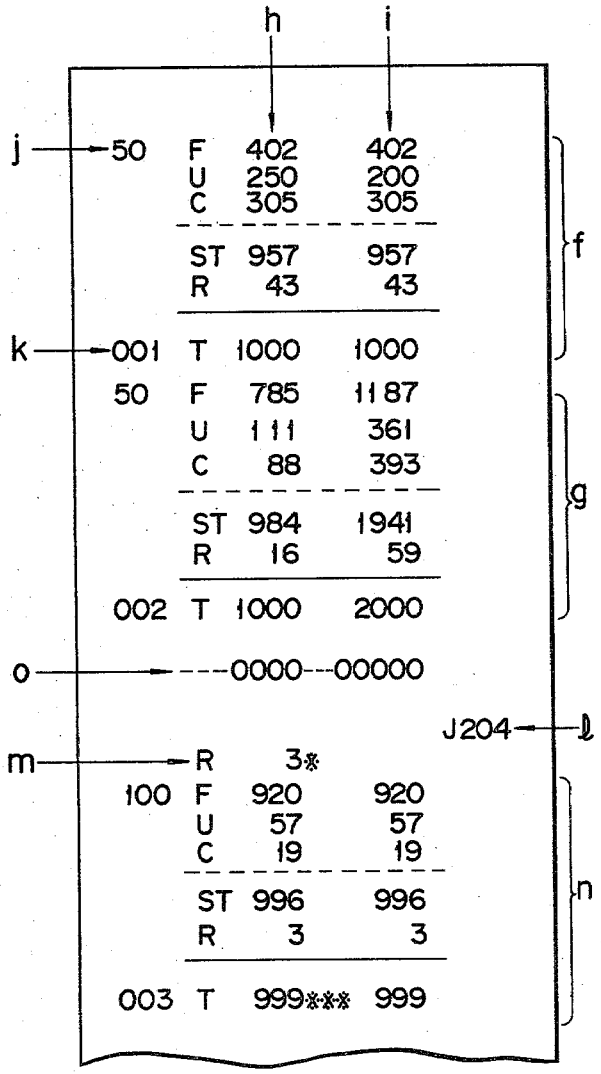
Figure 9:
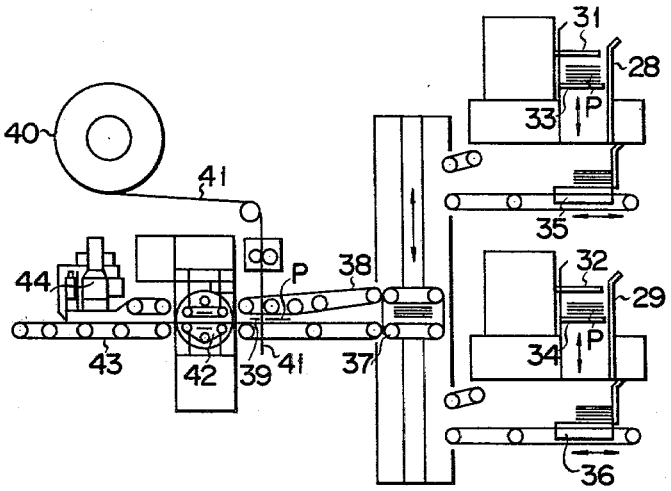
Figure 10:
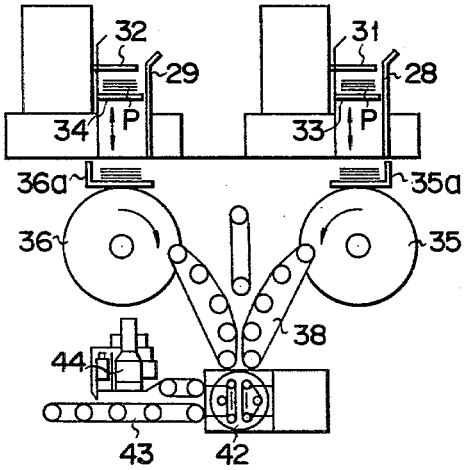

FIGS. 5A and 5B constitute a block diagram of a control system of the processing system;

FIG. 6 is a block diagram showing a discriminating section shown in FIG. 5B in detail;

FIG. 7 is a fragmentary plan view showing an example of the journal format print produced by a printing means;

FIG. 8 is a fragmentary view showing belts of a sorting and transferring means and a paper sheet clamped by the belts in a manner similar to FIGS. 2A and 2B; and FIGS. 9 and 10 are fragmentary schematics showing respective modifications of the apparatus for processing paper sheets according to the invention and provided with respective common transfer mechanisms.

Preferred embodiments of the invention shown in the drawings will now be described.

Figure 1A:
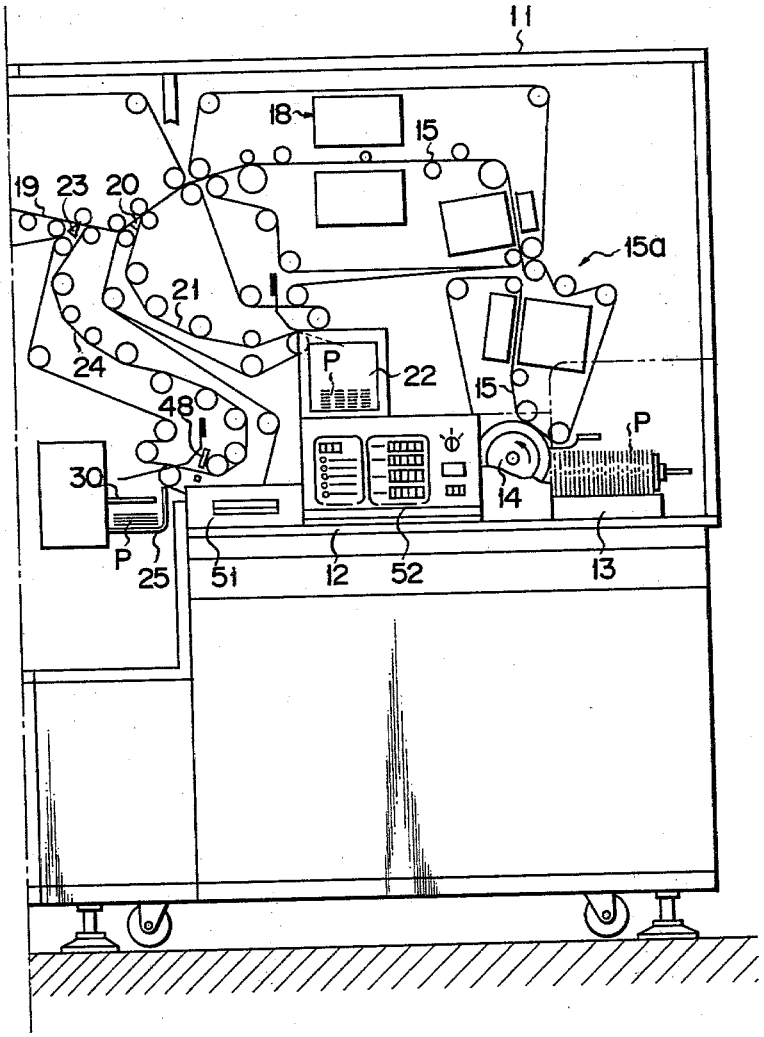
Figure 1B:
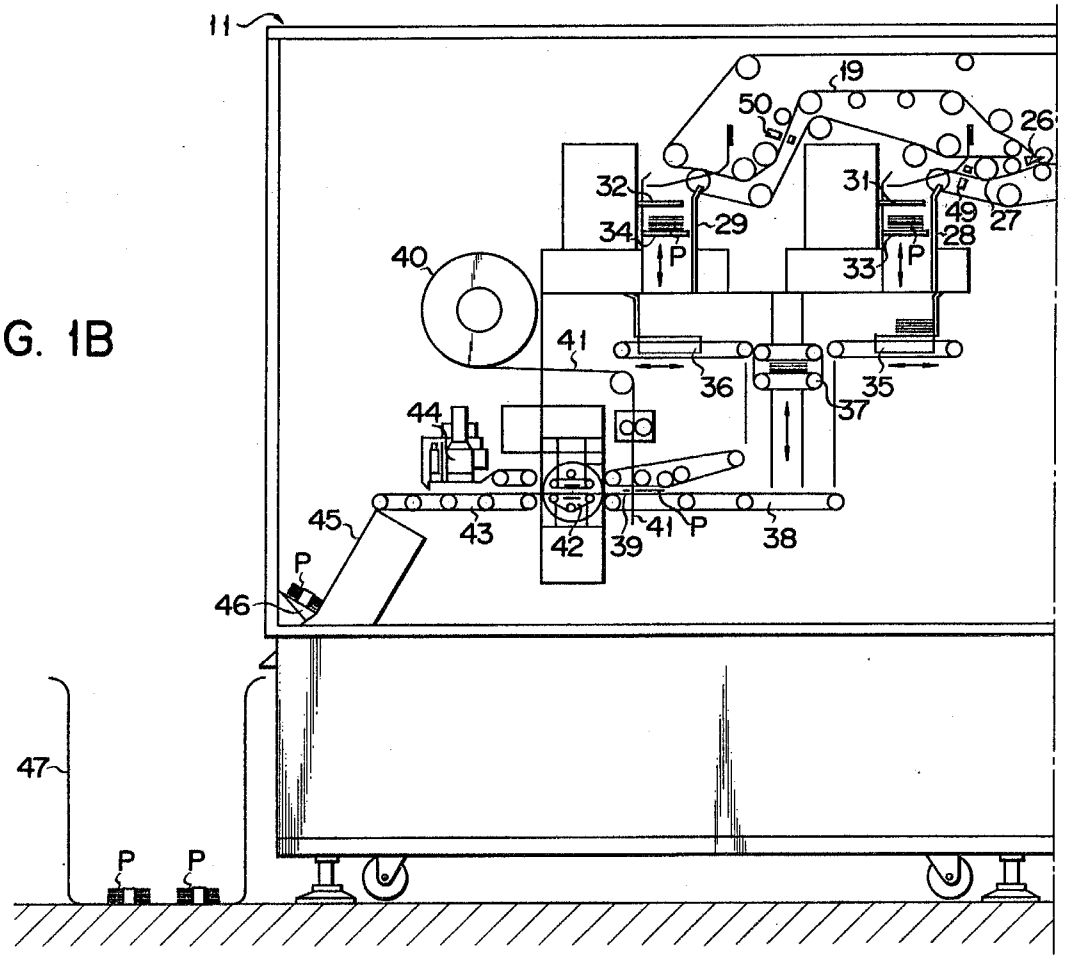

Referring to FIGS. 1A and 1B, designated at 11 is a frame of the paper sheet processing apparatus according to the invention, and a table 12 disposed on the right hand side of the frame 11 is provided with a paper sheet supplying section 13. In this paper sheet supplying section 13, paper sheets P to be processed, for instance 9 bank notes or securities, are loaded lot by lot (for instance 1,000 sheets each) with a magazine.

The paper sheets P in the supplying section 13 are supplied into the inside of the frame one after another by a take-out rotor 14. A paper sheet take-out and transfer unit 15*a* is connected at one end to the supplying section 13. The take-out and transfer unit 15*a* includes the take-out roller 14, and it also has a transfer path 15 extending up to a detecting section 18 for transferring paper sheets P thereto.

As shown in FIGS. 2A and 2B, the transfer path 15 includes a plurality of parallel conveyor belt pairs each consisting of belts 16*a* and 16*b* overlapping each other, these belt pairs being spaced apart by a constant interval. The interval between adjacent belt pairs and the disposition thereof relative to paper sheets are as shown in FIGS. 2A and 2B. The paper sheets P such as bank notes are folded very frequently during their circulation, and presumable creases are formed as shown by broken lines in FIGS. 2A and 2B. Usually, the paper sheet portions of these creases 17 and the neighboring portions thereof are most likely to be damaged or injured. The belt pairs 16 of the conveyor unit 15*a* are spaced apart and positionally related to these paper sheets P such that they do not clamp the creases 17. FIG. 2A shows a paper sheet being transferred in a longitudinal state, and FIG. 2B shows a paper sheet being transferred in a transversal state.

In the detecting section 18, a paper sheet P having been transferred thereto is optically detected there as will be described hereinafter, and a detection output signal produced from this section 18 is supplied to a discriminating section 102 (FIG. 5B) for effecting the following discrimination.

The paper sheets are sorted into fit paper sheets capable of processing within the apparatus and unfit paper sheets incapable of processing, these paper sheets being of the same denomination, and sometimes also into so-called other bank notes issued from a different bank although the denomination is the same. The fit paper sheets are further sorted into normal paper sheets qualified for the next circulation and damaged paper sheets not qualified for circulation due to stains and/or damages. The unfit paper sheets include those having extremely stained or damaged surface, those incapable of discrimination, forged paper sheets, those of different denominations irrelevant to the subject of being processed and also so-called overlapping sheets, that is, two or more sheets discriminated in the overlapped state in a manner to be described hereinafter.

The paper sheets P having passed through the detecting section 18 are further transferred to a little extent by the transfer path 15 and then led to a separate transfer path 19. The paper sheets having been discriminated at the detecting section 18 to be unfit sheets incapable of processing are led by a first sorting gate 20 provided on the transfer path 19 to a branch transfer path 21 and are progressively stacked in an unfit paper sheet collecting section 22.

Meanwhile, of the remaining paper sheets those discriminated to be other bank notes are led by a second sorting gate 23 to another branch transfer path 24 to be stacked in an other bank note collecting section 25.

Of the paper sheets having been discriminated to be fit sheets normal sheets are further transferred by the transfer path 19 and led through a third sorting gate 26 to a further branch transfer path 27 and stacked and collected in a normal paper sheet collecting section 28. Meanwhile, damaged paper sheets are further transferred by the transfer path 19 to be stacked and collected in a damaged paper sheet collecting section 29.

The transfer path 19 and sorting gates 20, 23 and 26 constitute a sorting transfer unit.

The individual collecting sections 25, 27 and 29 are provided with respective separator means 30, 31 and 32 which are actuated when the number of the stacked paper sheets reaches, for instance, 100 and separates the 100 paper sheets as one unit.

Of the separated paper sheet stacks each consisting of 100 paper sheets the normal paper sheet stack and damaged paper sheet stack are lowered by lift means 33 and 34 provided in the collecting sections 28 and 29 constituting a delivery mechanism to be delivered to respective horizontally driven carrier means 35 and 36 are moved thereby in the respective leftward and rightward directions to be delivered to a vertically driven common elevator means 37 provided mid way between both the carrier means.

The carrier means 35 and 36 and elevator means 37 constitute a transfer mechanism for transferring paper sheets from each delivery mechanism to a bundling unit to be described hereinafter.

The normal paper sheet collecting section 28 and damaged paper sheet collecting section 29 are symmetrically disposed with respect to the common elevator means 37. Thus, the normal paper sheet stack and damaged paper sheet stack are transferred an equal distance by the lift means 33 and 34, carrier means 35 and 36 and elevator means 37.

The paper sheet stacks are lowered in a clamped state by the common elevator means 37 to a lowermost position and thence delivered to a stack conveyor 38. From this conveyor 38 each paper sheet stack is supplied to a bundler 42, and as it passes a paper tape supply unit 39 provided before the bundler an end of a paper tape 41 supplied from a taper tape reel 40 is lapped over it. When the stack reaches the bundler 42, the paper tape is wound on the stack, and subsequently the paper tape is cut and glued in a cutting and glueing unit (not shown), thus producing a paper sheet bundle bound with paper tape.

The conveyor 38, bundler 42 and paper tape supply unit 39 constitute a bundling unit.

The paper sheet bundles thus formed are conveyed by a separate conveyor 43, and during this time a predetermined mark is printed on the paper tape by a printing means 44. Then, they are temporarily collected in a temporary bundle collecting section 45 provided at the last end of the conveyor 43.

In the afore-mentioned printing means 44, different marks are printed on the normal paper sheet bundles and damaged paper sheet bundles by previously sensing the kind of the paper sheet bundles.

The temporary bundle collecting section 45 is provided with a movable stopper 46 for preventing the dropping of paper sheet bundles, and when the stopper 46 is operated the bundles collected in the temporary bundle collecting section 45 are caused to drop into a bucket 47 disposed on the outside of the apparatus. The stopper 46 keeps the paper sheet bundles in the temporary bundle collecting section 45 until the paper sheet processing of one lot is completed, and only after completion of all operation of confirmation such as checkup of the number of paper sheets it is operated to cause the paper sheet bundles to drop into the bucket 47 at one time.

The paper sheets collected as other bank notes in the collecting section 25 are not automatically bundled, but temporarily collected below the separator means 30, and when the available space become full of paper sheets, the fact is appropriately informed to the operator by means of a chime so that the paper sheets may be removed. The removed paper sheets may be manually bundled by the operator, or they may be mechanically and automatically bundled by using an arrangement switch 73 (FIG. 3).

At the branch transfer paths 24 and 27 and an end portion of the transfer path 19 leading to the damaged paper sheet collecting section 29, detectors 48, 49 and 50 are provided near the respective collecting sections 25, 27 and 29. These detectors function as the so-called overlap detector for checking if there are no overlapping paper sheets. Each of these detectors 48, 49 and 50 comprises a light source for projecting light onto each paper sheet being transferred and a light receiving element, such as a photodiode, for receiving the transmitted light.

On the afore-mentioned table 12, a journal printer 51 as recorder and an operation panel 52 are mounted. The operation panel 52 consists of a substantially horizontal operation surface 52*a* and a substantially vertical operation surface 52*b*.

Figure 3:
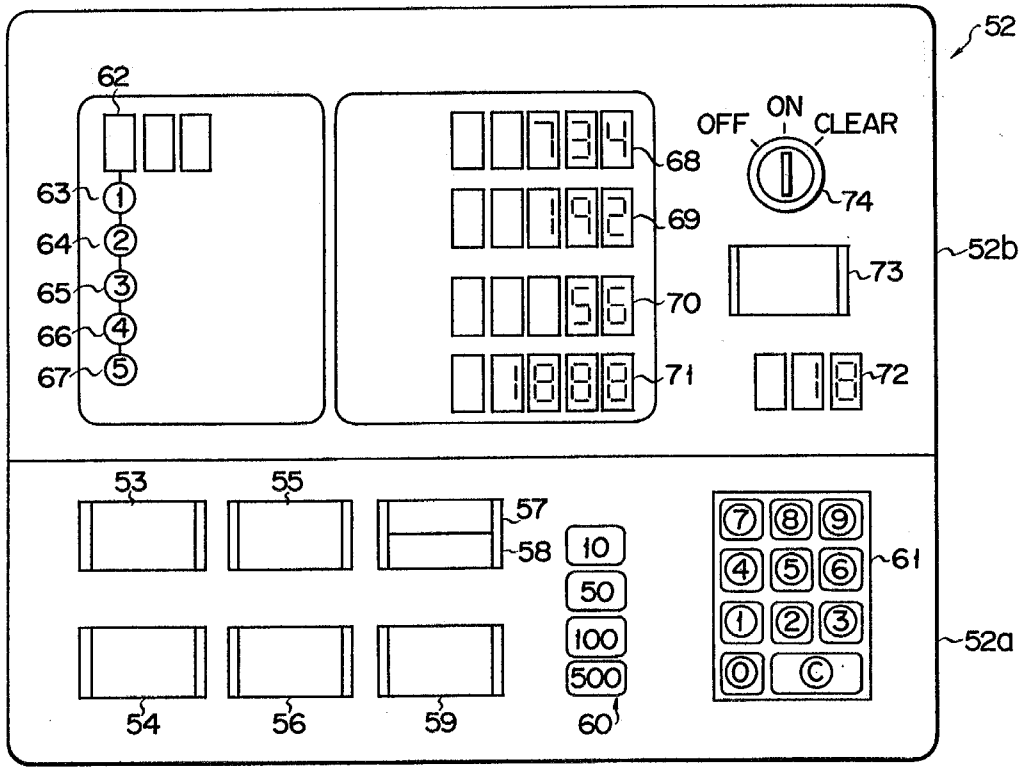
FIG. 3 is an enlarged view of an operation panel in the processing apparatus.

As shown in an enlarged view in FIG. 3, the operation panel 52 has various switches, display lamps and paper sheet number indicators provided on the panel surface. More particularly, the horizontal panel surface 52*a* of the panel 52 has a power source connection switch 53 to be depressed when closing the power source for the apparatus, with a button portion of the switch 53 thereby burning green, a power source disconnection switch 54 to be depressed when disconnecting the power source, with a button portion of the switch 54 thereby burning orange, a count check switch 55 to be depressed for checking the paper sheet number after one lot of sheets are loaded and processed, with a button portion of the switch 55 thereby burning green in case when coincidence of checking of the numbers is obtained and burning red in case when coincidence of checking of the numbers is not obtained, that is, in case of occurrence of a fault, a fault clear switch 56 with a button portion thereof burning red when the apparatus is automatically stopped due to occurrence of a defective state such as jamming and to be depressed after completion of disposal by removing the cause of defectiveness, a supply start switch 57 to be depressed for starting the supply of paper sheets, with a button portion of the switch 57 thereby burning green, a preparation completion lamp 58 burned green when the apparatus is rendered ready for supplying paper sheets, a supply stop switch 59 to be depressed for stopping the supply of paper sheets, a button portion of the switch 59 thereby burning orange, note kind setting keys 60 for setting the kind of notes by the operator according to the denomination of processed paper sheets and a ten-key set 61. The ten-key set 61 constitutes an input means, in which the number of paper sheets collected as unfit paper sheets in the collecting section 22 and taken out therefrom and counted by the operator is inputted.

The vertical panel surface 52*b* of the operating panel 52 has a fault indicator 62 for indicating the content of a fault such as jamming, when such a fault takes place, as a three-digit numeral code. On the surface 52*b* are provided a preparation non-completion lamp 63 which burns red if the fault clear switch 56 is not depressed although predetermined measures have been undertaken with respect to a faulty state, a sorting gate fault lamp 64 which burns red when a fault occurs in the sorting gates, a counting fault lamp 65 which burns red when a counting fault occurs in counters to be described later, a defective collection lamp 66 which burns red when defective paper sheet collection occurs in any one of the collecting sections 22, 25, 28 and 29 and a defective bundling lamp 67 which burns red when defective bundling occurs in the bundling unit. The lamps 64 to 67 are extinguished by depressing the fault clear switch 56 when predetermined measures are taken after removal of a fault.

The vertical panel surface 52*b* of the operating panel 52 also has a normal paper sheet number indicator 68 for indicating the number of normal paper sheets, a damaged paper sheet number indicator 69, an other bank note number indicator 70 and a total number indicator 71 for indicating the total number of paper sheets, these indicators each having five digits, a three-digit indicator 72 for indicating the number of unfit paper sheets inputted through the afore-mentioned ten-key set 61, an arrangement switch 73 for controlling the start and stop of the operation of a discriminating section 102 (FIG. 5B) for discriminating normal paper sheets, damaged paper sheets with a button portion of the switch 73 burning orange at the time of the start, and a key switch 74.

The key switch 74 is operable only with a special key owned by the supervisor, and it has "OFF", "ON" and "CLEAR" positions. In the "OFF" position, the operation of the power source connection switch 53 is made ineffective, in the "ON" position the operation of the switch 74 is made effective, and in the "CLEAR" position the apparatus is initialized while also released if the apparatus has been locked due to non-coincidence occurring at the time of checking up numbers of paper sheets.

Figure 4:
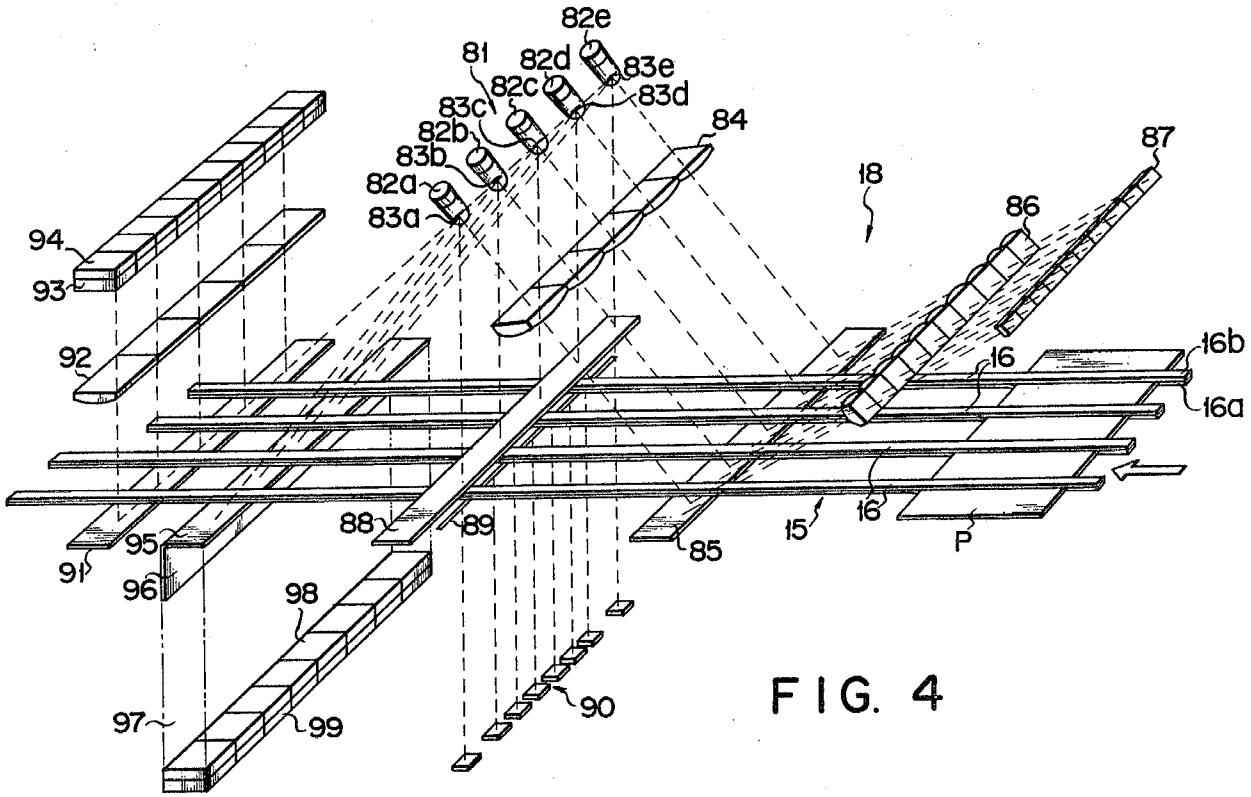
FIG. 4 is an enlarged perspective view showing a detecting section.

FIG. 4 shows the specific construction of the detecting section 18. A light source 81 is disposed above the transfer path 15. The light source 81 consists of five incandescent lamps 82*a* to 82*e* having respective filaments 83*a* to 84*e* arranged in a line extending above and across the transfer path 15.

Direct light from the light source 81 is converted by an optical system 84 consisting of cylindrical lenses into a parallel light beam which is incident on a reference reflector 85 provided beneath and in the vicinity of the transfer path 15, and reflected light is gathered by an optical system 86 consisting of cylindrical lenses and led therethrough to a first light receiving section 87, which is designated as "first L.R. section" in FIGS. 5A, 5B and 6. The first light receiving section 87 consists of a plurality of light receiving elements, such as photodiodes.

Usually, direct light from the light source 81 is reflected by the reference reflector 85 and led to the first light receiving section 87, and when a paper sheet reaches a position corresponding to the reflector 85, light from the light source 81 is incident on the paper sheet P and reflected thereby to be led to the first light receiving section 87 for conversion into an electric signal. Also, indirect light from the light source 81 is diffused by a diffuser 88 and led through a slit 89 provided beneath the transfer path 15 to a second light reciving section 90 consisting of a plurality of light receiving elements 90, such as photodiodes. The section 90 is designated as "second L.R. section" in FIGS. 5A, 5B and 6.

Usually, indirect light from the light source 81 is directly led to the second light receiving section 90, and when a paper sheet P reaches a position corresponding to the scattering member 88, indirect light from the light source is incident on the paper sheet P and transmitted therethrough to be led to the second light receiving section 90 for conversion into a corresponding electric signal.

Indirect light from the light source 81 is also incident on a diffusing reflector 91 provided beneath the transfer path 15, and the reflected light is gathered by an optical system 92 consisting of cylindrical lenses to be transmitted through a color decomposition filter 93 to a third light receiving section 94, which is designated as "third L.R. section" in FIGS. 5A, 5B and 6. The filter 93 divides the incident light into a long wavelength range component and a short wavelength range component. The third light receiving section 94 consists of a plurality of light receiving elements, such as photodiodes, arranged in a straight line crossing the transfer path 15.

Usually, indirect light from the light source 81 is diffused and reflected by the diffusing reflector 91 to be led to the third light receiving section 94, and when a paper sheet P reaches a position corresponding to the reflector 91 indirect light from the light source 81 is incident on the paper sheet P and reflected thereby to be led to the third light receiving section 94 for conversion into a corresponding electric signal. Further, indirect light from the light source 81 is transmitted through a transparent plate 95 provided beneath and in the vicinity of the transfer path 15, and the transmitted light is diffused by a diffuser 96 and then substantially perfectly diffused by a mirror box 97 to be transmitted through a color decomposition filter 98 to a fourth light receiving section 99, which is designated as "fourth L.R. section" in FIGS. 5A, 5B and 6.

The filter 98 divides the incident light into a long wavelength range component, a medium wavelength range component and a short wavelength range component. The fourth light receiving section 99 comprises a plurality of light receiving elements, such as photodiodes, arranged in a straight line crossing the transfer path 15. Usually, indirect light from the light source 81 is directly led to the fourth light receiving section 99, and when a paper sheet P reaches a position corresponding to the transparent plate 95, indirect light from the light source 81 is incident on the paper sheet P and transmitted therethrough to be led to the fourth light receiving section 99 for conversion into a corresponding electric signal.

FIGS. 5A and 5B outlines the control system for the paper sheet processing apparatus shown in FIG. 1. It comprises a main control section 101, to which a discrimination section 102 is connected through a line 101*a*. The discriminating section 102 discriminates the paper sheets and sorts them into normal paper sheets, damaged paper sheets, other bank sheets and unfit paper sheets according to the output signals from the detecting section 18, that is, output signals from the first to fourth light receiving sections 87, 90, 94 and 99. The results of discrimination are coupled through the line 101*a* to the main control section 101.

As is shown in detail in FIG. 6, the outputs of the first to fourth light receiving sections 87, 90, 94 and 99 are coupled through respective amplifiers 103*a* to 103*d* and integrating circuits 104*a* to 104*d* to signal combination circuits 105*a* to 105*d*. The signal combination circuits combine output signals of the light receiving elements of the respectively corresponding light receiving sections 87, 90, 94 and 99 and produce the resultant signals. These signals are supplied to respective comparator circuits 106*a* to 106*e*.

As reference level, level (a) is supplied to the comparator circuit 106*d*, a level (b) to the comparator circuit 106*a*, a level (c) to a comparator circuit 106*c*, and a level (d) to a comparator circuit 106*b*. The levels (a) and (c) are used to sort the paper sheets into fit sheets and unfit sheets. The levels (b) and (c) are used to sort the fit paper sheets into normal sheets and damaged sheets. The reference levels (a) and (b) actually represent fixed widths, one of which is defined by the upper and lower limits $a_1$ and $a_2$ and the other of which is defined by $c_1$ and $c_2$ as shown in the table below.

The outputs of the comparator circuits 106*a* to 106*e* are supplied to a discriminating circuit 107, which effects sorting of the paper sheets on the basis of the results of comparison in the comparator circuit 106*a* to 106*e*.

TABLE

| Paper sheet | Level a | b | c | d | e |
|---|---|---|---|---|---|
| Unfit paper sheet | $x > a_1$ or $a_2 > x$ | — | $x > c_1$ or $c_2 > x$ | — | — |
| Damaged paper sheet | $a_1 \geqq x \geqq a_2$ | $b > x$ | $c_1 \geqq x \geqq c_2$ | $d > x$ | — |
| Normal paper sheet | $a_1 \geqq x \geqq a_2$ | $b \leqq x$ | $c_1 \geqq x \geqq c_2$ | $d \leqq x$ | — |
| Other bank note | — | — | — | — | $e \leqq x$ |

The reference level (e) in the table above is provided for discriminating other bank notes. This level (e) is supplied to the comparator circuit 106*e*.

Comparison is made between the reference levels (a), (b), (c), (d) and the levels of output signals from the corresponding signal combination circuits 105*a*, 105*b*, 105*c*, 105*d*. Judgment is made as to whether a sorted paper sheet denotes an unfit, damaged or normal type, in accordance with the result of the above-mentioned comparison which meets any of the conditions listed in the above table. If the result of comparison meets the condition shown in the column (e), independently of the reference levels (a), (b), (c), (d), then a paper sheet thus sorted is distinguished as an "other bank note".

The results of comparison are supplied to the main control section 101. In the table, (x) designates the level of the output signals of the signal combination circuits 105*a* to 105*d*. The discriminating circuit 107 selectively produces a normal paper sheet signal, a damaged paper sheet signal and an other bank note signal in accordance with the kind of the discriminated paper sheet, and also it produces a sum signal every time each of these signals is produced.

The normal paper sheet signal produced from the discriminating circuit 107 is supplied to a normal paper sheet counter 108, the damaged paper sheet signal to a damaged paper sheet counter 109, the other bank note signal to an other bank note counter 110, and the sum signal to a sum counter 111. The counters 108 to 111 respectively count normal paper sheets, damaged paper sheets, other bank notes and the sum of these counts when corresponding signals are supplied from the discriminating circuit 107.

The count values of the respective counters 108 to 111 are coupled to a counting/calculation control section 112, to which other counters 113 to 116 for counting normal paper sheets, damaged paper sheets, other bank notes and the sum of counts are also connected. Further, indicators 68 to 71 for indicating the number of normal paper sheets, number of damaged paper sheets, number of other bank notes and sum of these numbers are connected to the control section 112.

The normal paper sheet counter 113 counts normal paper sheets collected in the normal paper sheet collecting section 28 in accordance with the detection signal from the paper sheet detector 117 provided at the inlet of the section 28 and supplies the count value to the counting/calculation control section 112. The damaged paper sheet counter 114 counts damaged paper sheets collected in the damaged paper sheet collecting section 29 according to the detection signal supplied from the paper sheet detector 118 provided at the inlet of the section 114 and supplies the count value to the control section 112. The other bank note counter 115 similarly counts collected other bank notes according to the detection signal from the detector 119 and supplies the count value to the control section 112. The sum counter 116 counts paper sheets passing by a detector 120, which is provided before the second sorting gate 20 and after the first sorting gate 20 in the direction of transfer, according to the detection signal from the detector 120 and supplies the counting/calculation control section 112.

The counters 113 to 116 are five-digit counters.

The counting/calculation control section 112 checks up the counts of the counters 108 to 111 with the contents of the corresponding counters 113 to 116, and if there is any pair of counters, the counts of which do not coincide with each other, it delivers a non-coincidence detection signal through a line 101*b* to the main control section 101 to prevent erroneous counting.

In the counting/calculation control section 112, with the depression of the count check switch 55 (FIG. 3) the number of rejected unfit paper sheets and the count of the sum counter 116 are added together and the resultant sum is checked with the preset value of one lot, here 1,000 paper sheets being set as one lot. If the checked number coincides with the preset value, the count values of the counters 113 to 115, that is, the number of paper sheets, the number of damaged paper sheets and the number of other bank notes are displayed on the respective indicators 66 to 70, and also the sum of the count of the counter 116 and the number of rejected unfit paper sheets is displayed on the indicator 71.

With the depression of the count check switch 55 the counting/calculation control section 112 supplies the counts of the counters 113 to 116, that is, the numbers of the respective sorted paper sheets and the sum, through the line 101*b* to the main control section 101, while the counting/calculation control section 112 also effects predetermined calculations of adding the previous total values of the individual sorted paper sheet numbers and sum, memorized at the time of the previous checkup, to the respective value supplied this time and supply the new total values to the main control section 101.

To the main control section 101 is connected an operation control section 121, to which are in turn connected various switches 122 such as the afore-mentioned switches 53 to 57, 73 and 74, the note kind setting key 60 and the ten-key set 61.

To the main control section 101 is also connected a recording control section 123, to which the afore-mentioned printer 51 is connected in turn.

To the main control section 101 is further connected a display control section 124, to which the fault indicator 62, display lamps 125 such as the lamps 58 and 63 to 67 and unfit paper sheet number indicator 72 are connected. Further, to the main controller 101 is connected a mechanism control section 126, to which a take-out and transfer control section 127, a sorting and transfer control section 128, a collection and sorting control section 129, a stack take-out control section 130 and a bundling and printing control section 131 are in turn connected.

The take-out and transfer control section 127 controls the take-out rotor 14 and transfer path 15, the sorting and transfer control section 128 controls the transfer path 19, sorting gates 20, 23 and 26 and branch transfer paths 21, 24 and 27, and the collection and sorting control section 129 controls the separator means 30, 31 and 32 and lift means 33 and 34. The stack take-out control section 130 controls the carrier means 35 and 36 and lift means 37, and the bundling and printing control section 131 controls the bundle conveyor 38, paper tape supply unit 39, bundler 42, bundle conveyor 43, printing means 44 and bundle stopper 46.

Further, the detectors 48 to 50 are connected to the main control section 101.

The operation of the above construction will now be described. By depressing the power source connection switch 53 various checks are automatically effected by the main control section 101, and when the apparatus is rendered ready for operation, a preparation completion lamp 58 is turned on. Then, one lot of (that is, 1,000) paper sheets P are accommodated irrespective of their front and back sides and also of their longitudinal and transversal orientations in a magazine, which is then set in the supplying section 13. In this state, the supply start switch 57 is depressed, whereby the signal therefrom is coupled through the operation control section 121 to the main control section 101, which then supplies an operation start signal through the mechanism control section 126 to the take-out and transfer control section 127 and the sorting and transfer control section 128. Thus, the take-out rotor 14 is started to rotate, and the paper sheets P in the supplying section 13 are taken out one after another by the rotor 14 and supplied to the transfer path 15. The paper sheets being transferred along the transfer path 15 pass by the detecting section 18, whereby their discrimination is effected in the discriminating section 102 for sorting them into normal sheets, damaged sheets and unfit sheets, with the result of discrimination being supplied to the main control section 101. On the basis of the result of discrimination, the main control section 101 supplies sorting signals to the sorting and transfer control section 128 for operating the individual sorting gates 10, 23 and 26, whereby the individual paper sheets are sorted and collected in predetermined collecting sections. More particularly, paper sheets discriminated to be unfit sheets are passed through the sorting gate 20 and collected in the unfit paper sheet collecting section 22, those discriminated to be other bank sheets are passed through the sorting gate 23 and collected in the other bank note collecting section 25, those discriminated to be normal sheets are passed through the sorting gate 26 and collected in the normal paper sheet collecting section 28, and those discriminated to be damaged paper sheets are directly transferred to the damaged paper sheet collecting section 29.

At this time, the counters 113 to 116 are operated by signals from the respectively corresponding detectors 117 to 120 and count the collected fit paper sheets, other bank sheets and the sum of these sheets. Meanwhile, the counters 108 to 111 are operated by signals supplied to them from the discriminating section 102 on the basis of the discrimination and count the fit paper sheets, other bank notes and the sum of these sheets at the time of the discrimination. Further, output signals of the detectors 48 to 50 are supplied to the main control section 101, whereby the main control section 101 effects checking as to whether there are overlapped paper sheets immediately before being collected in the collecting sections. More particularly, each of the detectors 48 to 50 produces an output signal according to the dose of light transmitted through a paper sheet which passes each of the detectors, and the main control section 101 compares the signal level with a predetermined reference level and determines the presence of two or more sheets overlapped over one another if the signal level is lower than the reference level. When such overlapping is detected, the main control section 101 stops the processing operation of the apparatus and instructs the operator to take corresponding predetermined measures. Further, at this time the counting/calculation control section 112 checks up the numerical values of the counters 108 to 111 with those of the counters 113 to 116 and, if there is any pair of counters whose contents do not coincide with each other, delivers a signal representing the non-coincidence to the main control section 101. In this case, the main control section 101 stops the processing operation of the apparatus, causes the counting fault lamp 65 to burn and the button portion of the fault clear switch 56 to burn red, and further displays the content of the fault as a numerical code on the fault indicator 62 for instructing the operator to take predetermined measures.

The main control section 101 checks the numerical values of the counters 113 to 115 through the counting-/calculation control section 112, so that when one of these numeral values reaches 100, for instance, it delivers a one hundred sheet separation command coupled through the mechanism control section 126 to the collection and sorting control section 129. In this way, separation of one hundred paper sheets is effected by the separator means 30 to 32 provided in the respective collecting sections 25, 28 and 29. For example, when the numerical value of the normal paper sheet counter 113 reaches 100, the separator means 31 of the collecting section 28 is introduced into the collecting section 28, whereby following normal paper sheets are temporarily stacked thereon. The separated stack of one hundred normal paper sheets is transferred by the lift means 33 which is operated this time over to the carrier means 35. After the normal paper sheet stack is transferred over to the carrier means 35, the lift means 33 is raised again to the initial position. At this time, the separator means 21 is retreated from the inside of the normal paper sheet collecting section 28, whereby the following normal paper sheets having been temporarily stacked on the separator means 21 are handed over to the lift means 33. Meanwhile, the carrier means 35 is moved toward the left to transfer the normal paper sheet stack over to the common elevator means 37, which in turn supplies the stack to the bundling unit. In the bundling unit the normal paper sheet stack is bundled with the paper tape 41, and a mark representing the normal paper sheet is printed on the tape. Thereafter, the paper sheet bundle is temporarily stored in the temporary bundle collecting section 45.

Damaged paper sheets are similarly transferred through the take-out mechanism and transfer mechanism to the bundling unit, in which the stack is bundled with the paper tape 41 and provided with a mark representing the damaged paper sheet, and collected in the temporary bundle collecting section 45.

When one lot of paper sheets (1,000 sheets) P set in the supplying section 13 are all supplied and processed, the supply stop switch 59 is depressed, whereby the signal therefrom is coupled through the operation control section 121 to the main control section 101, which in turn supplies a stop signal to the take-out and transfer control section 128 and the sorting and transfer control section 128. As a result, the operations of the take-out rotor 14, transfer paths 15 and 19 and branch transfer paths 21, 24 and 27 are stopped. Then, the operator manufally counts the unfit paper sheets collected in the unfit paper sheet collecting section 22 and inputs the count number through the ten-key set 61. The input numerical value is coupled through the operation control section 121 to the main control section 101, whereby the main control section 101 displays the input number on the unfit paper sheet number indicator 72. Next, the operator depresses the count check switch 55, whereby the signal therefrom is coupled through the operation control section 121 to the main control section 101, which then supplies a count check command together with the unfit paper sheet number to the counting/calculation control section 112. The counting/calculation control section 112 adds the unfit paper sheet number to the content of the sum counter 116 and checks the resultant sum with the preset number of one lot. If these numbers coincide with each other, the numerical values of the counters 113 to 115 on the respective indicators 68 to 70 and also the sum of the numerical value of the counter 116 and the number of the rejected unfit paper sheets on the indicator 71 are displayed. Further, the counting/calculation control section 112 supplies a coincidence signal to the main control section 101, which then causes the button portion of the count check switch 55 to burn green and also supplies a stopper operation signal to the bundling and printing control section 131. As a result, the stopper 46 in the temporary bundle collecting section 45 is operated to cause bundles temporarily collected therein to drop them into the bucket 47 at one time. Further, when coincidence is obtained in the aforementioned checking, the counting/calculation control section 112 feeds the contents of the counters 113 to 116, the unfit paper sheet number coupled through the ten-key set 61 and the sum of these numbers through the main control section 101 to the recording control section 123, while at the same time the totals of the different kinds of paper sheets and sum of these numbers are calculated and these totals are supplied to the recording control section 123. As a result, the printer 51 starts the operation of printing a section labeled (f) or (g) in a format as shown in FIG. 7. More particularly, the normal paper sheet number (F), damaged paper sheet number (U), other bank note number (C), sum (ST) of these numbers, unfit paper sheet number (R) and total (T). The results of processing for one lot are printed in a section labeled (h), and the totals from the outset are printed in a section labeled (i). In the left upper corner portion labeled (j), the kind of note handled is indicated, that is, a content specified by note kind setting keys 60 is printed. Labeled (k) is the serial number of processing, and it is continuously counted up for the period, during which the power source for the apparatus is connected. Labeled (l) is a code representing the content of a fault, with which the apparatus has been stopped.

When non-coincidence occurs in the checking in the counting/calculation control section 112, the section 112 displays nothing on the indicators 68 to 71 and delivers a non-coincidence signal to the main control section 101. As a result, the main control section 101 causes the button portion of the count check switch 55 to burn red and also locks the apparatus in the inoperative state. When this takes place, the operator counts again the unfit paper sheet number having been previously counted. If the previous count has been wrong, the correct number is inputted afresh through the ten-key set 61. When the new unfit paper sheet number is entered, the main control section 101 displays it on the indicator 72 afresh and extinguishes the button portion of the count check switch 55 to give the operator a change of making check-up again. If burning green of the button portion of the count check switch 55 takes place as a result of operation of the count check switch 55 again by the operator at this time, the coincidence is confirmed, so that the following operation as mentioned earlier takes place continuously. If the button portion of the switch 55 burns red, indicating non-coincidence agains, the apparatus is locked again. The paper sheet bundle stopper 46 is not operated unless the button portion of the switch 55 burns green with coincidence of the checkup. Thus, unless this condition is met, the paper sheet bundles in the temporary bundle collecting section 45 are not discharged.

In case when there is neither error of the count of the unfit paper sheets, operational errors such as casual detachment of a paper sheet during the processing nor excess or difficency of paper sheet bundles in the temporary bundle collecting section 45, the non-coincidence is attributed to an excess or difficiency of the number of supplied paper sheets.

When the button portion of the count check switch 55 is burning red by switching the key switch 74 to the "CLEAR" position the signal supplied therefrom the main control section 101 causes the section 101 to release the apparatus from the locked state and also supply a display command to the counting/calculation control section 112.

As a result, the counting/calculation control section 112 causes the indicators 68 to 71 to display respective paper sheet numbers and sum of these numbers as a result of addition of the unfit paper sheet number in the manner as mentioned earlier. At this time, the sum is not 1,000.

At this time, the counting/calculation control section 112 feeds the individual paper sheet numbers, the sum of these numbers as well as the total of these numbers at this instant to the recording control section 123. As a result, the printer 51 starts the operation of printing a section labeled (m) and (n) in the format shown in FIG. 7.

In other words, when non-coincidence results in the checkup in the counting/calculation control section 112, an unfit paper sheet number printing order is supplied from the section 112 to the recording control section 123, whereby the printer 51 prints only the content of the section (m), that is, only the number of unfit paper sheets coupled through the ten-key set 61.

When the apparatus is subsequently released from the locked state by operating the key switch 74, the counting/calculation control section 112 delivers a printing command for printing the individual paper sheet numbers to the recording control section 123, whereby the printer 51 prints the content in the section (n), that is, the normal paper sheet number (F), damaged paper sheet number (U), other bank note number (C), sum (ST) of these numbers, unfit paper sheet number (R) and total number (T). Non-coincidence with the preset number is indicated by a symbol (*). Further, a format sentence as labeled (o) is printed when the kind of paper sheets processed is changed or when the apparatus is wholly cleared.

As has been shown, with the instant embodiment the rejected unfit paper sheet number is inputted as key-in-data through the ten-key set for addition to the fit paper sheet number, and in some case the other bank note number, so that the sum may be automatically checked with a preset number of one lot, the processing can be made speedily and accurately. In addition, since the processed paper sheets are collected in the temporary collecting section 45 until the processing of one lot is completed, in case of occurrence of non-coincidence in the checking of counts it is necessary to check only the paper sheets of the lot under the processing, so that it is possible to alleviate the operation of confirmation and improve the accuracy of confirmation.

Further, since with this embodiment substantially the same distance is provided for the transfer of paper sheets from the normal paper sheet and damaged paper sheet collecting sections 28 and 29 to the bundling unit, the paper sheet transfer control and bundling control are simplified, and also an effect of preventing transfer errors can be obtained.

Furthermore, since with this embodiment a plurality of belt pairs 16 constituting the take-out and transfer system are adapted to clamp other portions of paper sheets P than presumed creases, the creases of the paper sheet and the neighboring portions thereof which are particularly subject to contamination and breakage can be sufficiently detected without being influenced by the belts.

In the transfer path 19 after the detecting section 18, a plurality of belt pairs 19*a* and 19*b* constituting the transfer path 19 are spaced apart and disposed relative to the paper sheet P being transferred such that these belt pairs coincide with respective presumed creases 17. Since with this arrangement the crease areas of the paper sheet P are clamped by the belt pairs in the transfer path 19, a transfer fault such as jamming is less likely to result during the transfer, and steady and reliable transfer of paper sheets can be ensured.

FIGS. 9 and 10 show modifications of the mechanism for transferring normal and damaged paper sheets from their collecting sections to the bundling unit. In these Figures like parts as in the corresponding mechanism in FIG. 1B are designated by like reference numerals.

In the modification of FIG. 9, normal paper sheet collecting section 28 and damaged paper sheet collecting section 29 are arranged in the vertical direction, and common elevator means 37 is located on one side of these sections. Stack conveyor 38 is connected at its front end to the elevator means 37 substantially at the center portion of the lift stroke.

A stack of paper sheets P lowered from for instance, normal paper sheet collecting section 28 by lift means 33 is transferred over to carrier means 35 provided therebeneath and horizontally transferred to the left by the carrier means to be transferred at the left end thereof over to the elevator means 37 raised up to the position of the carrier means 35. The elevator means 37 lowers the paper sheet stack in the clamped state and stops at an intermediate position of the stroke to transfer the paper sheet stack over to the paper sheet stack conveyor 38.

The paper sheet stack is then led to paper tape supply unit 39, in which the paper tape 41 supplied from the paper tape reel 40 is lapped over the stack. The paper tape 41 is then wound on the stack in the bundler 42. The paper sheet bundle supplied from the bundler 42 is transferred by the bundle conveyor 43 and provided with a predetermined mark printed on it by the printer 44, and then it is supplied to the temporary bundle collecting section (not shown here).

In the modification of FIG. 10, the normal paper sheet and damaged paper sheet collecting sections 28 and 29 are in a horizontal positional relation to each other like the case of FIG. 1B, but carrier means 35 and 36 consist of respective rotary drums. The rotary drums are disposed right beneath respective collecting sections 28 and 29 and are rotated in opposite directions. Paper sheet stack retainers 35*a* and 36*a* are each provided between each rotary drum and the corresponding collecting section.

Stack conveyor 38 is vertically disposed between both the rotary drums, with its upper end corresponding to both the rotary drums and its lower end corresponding to the bundler 42.

A stack of paper sheets P lowered from, for instance, the normal paper sheet collecting section 28 by the lift means 33 is received once by the paper sheet retainer 35*a* and thence transferred over to the rotary drum 35. The drum is rotated by a constant angle to hand the paper sheet stack over to the conveyor 38. The paper sheet stack transferred to the conveyor 38 is supplied to the bundler 42 from above. The bundler 42, printing means 44 and conveyor 43 are the same in construction as those in FIG. 1B. Also, paper tape is supplied to the paper sheet stack from a paper tape reel (not shown here) in the same manner as in the case of FIG. 1B.

In this modification, the vertically disposed bundle conveyor 38 also takes the role of the common elevator means in the arrangement of FIG. 1B.

With the modifications of FIGS. 9 and 10, like the construction of FIG. 1B, substantially the same distance is provided for the transfer of paper sheets from the normal paper sheet and damaged paper sheet collecting sections 28 and 29 to the bundling unit, so that the paper sheet transfer control and bundling control can be simplified.

What we claim is:

1. An apparatus for processing paper sheets comprising:

a supplying section adapted to receive a predetermined number of paper sheets to be processed said sheets being inserted into said supplying section as one lot;

a take-out and transfer means for removing and transferring paper sheets one after another from said supplying section;

detecting means for detecting paper sheets transferred by said take-out and transfer means;

discriminating means, connected to said detecting means, for sorting paper sheets at least into fit sheets and unfit sheets according to an output signal from said detecting means;

counting means for counting at least paper sheets determined by said discriminating means to be fit sheets;

sorting and transferring means for sorting paper sheets and transferring the individual sorted paper sheets in accordance with the result of discrimination by said discriminating means;

collecting sections for separately receiving respective paper sheets sorted by said sorting and transferring means said collecting sections including at least an unfit paper collecting section;

input means for manually inputting data representing the actual number of unfit paper sheets collected in said unfit paper sheet collecting section of said collecting sections;

checkup means for adding the number of fit paper sheets as counted by said counting means to the number of unfit paper sheets manually inputted via said input means and checking the resultant sum against a preset number corresponding to the number of sheets loaded into said supply section; and display means for displaying the number of paper sheets inputted via said input means and the added result obtained from said checkup means.

2. An apparatus for processing paper sheets according to claim 1, further comprising:

a take-out mechanism for removing a predetermined number of paper sheets stacked in said fit paper sheet collecting section;

bundling means connected to said take-out mechanism for bundling a constant number of paper sheets taken out by said take-out mechanism; and a temporary paper sheet bundle collecting means provided inside said apparatus for temporarily storing paper sheet bundles until the processing of one lot of paper sheets is completed.

3. An apparatus for processing paper sheets comprising:

a supplying section, in which a predetermined number of paper sheets to be processed are set as one lot;

take-out and transfer means for taking out and transferring paper sheets one after another from said supplying section;

a detecting section for detecting paper sheets transferred by said take-out and transfer means;

a discriminating section connected to said detecting section such as to sort paper sheets at least into normal paper sheets, damaged paper sheets, these paper sheets being of the same denomination and fit for being processed, and paper sheets unfit for being processed according to the output signal from said detecting section;

a counting section for counting paper sheets sorted as normal and damaged paper sheets;

sorting and transferring means for sorting paper sheets and transferring the individual sorted paper sheets in accordance with the result of discrimination by said discriminating section;

collecting sections for separately receiving normal paper sheets, damaged paper sheets and unfit paper sheets sorted by said sorting and transferring means;

an input section for manually inputting the actual number of paper sheets collected in said unfit paper sheet collecting section of said collecting sections;

a checkup section for adding the numbers of the normal and damaged paper sheets counted in said counting section and the number of unfit paper sheets coupled through said input section and checking up the resultant sum with a preset number; and a recording section for recording the result of checkup in said checkup section.

4. An apparatus for processing paper sheets according to claim 3, further comprising:

a take-out mechanism for removing a predetermined number of paper sheets stacked in said normal and damaged paper sheet collecting sections;

bundling means connected to said take-out mechanism for bundling a constant number of paper sheets taken out by said take-out mechanism; and a temporary paper sheet bundle collecting means provided inside said apparatus for temporarily storing paper sheet bundles until the processing of one lot of paper sheets is completed.

5. An apparatus for processing paper sheets according to claim 3, further comprising:

carrying means for removing a predetermined number of paper sheets collected in the normal and damaged paper sheet collecting sections respectively, said carrying means including a pair of horizontally driven carriers each of which is disposed under said corresponding normal and damaged paper sheet collecting sections, and a common elevator connected to said paired carriers at one end and said bundling means at the other end; and bundling means for bundling a constant number of paper sheets carried by said carrying means, whereby paper sheet stack in said normal paper sheet and damaged paper sheet collecting sections are transferred substantially by the same distance to said bundling means.

6. The apparatus for processing paper sheets according to claim 1 or 3, wherein said take-out and transfer means includes a plurality of parallel belt pairs each consisting of upper and lower belts, the respective belt pairs being adapted to clamp the other portions of a paper sheet than the crease-producing supposedly folded portions of the paper sheet and the neighboring portions thereof.

7. The apparatus for processing paper sheets according to claim 1 or 3, wherein said take-out and transfer means includes a plurality of parallel belt pairs each consisting of upper and lower belts, said respective belt pairs being adapted to clamp the crease-producing supposedly folded portions of the paper sheet.

8. The apparatus for processing paper sheets according to claim 1 or 3, further comprising: detectors for detecting overlapped paper sheets, said detectors being provided near the respective collecting sections.

* * * * *